US007303669B2

(12) United States Patent
Monneret

(10) Patent No.: US 7,303,669 B2
(45) Date of Patent: Dec. 4, 2007

(54) GRATE FOR CLOSING A DRAIN AND SIMILAR

(75) Inventor: Jean-Jacques Monneret, Lyons (FR)

(73) Assignee: Norinco, Saint Crepin Ibouvillers (FR)

( * ) Notice: Subject to any disclaimer, the term of this patent is extended or adjusted under 35 U.S.C. 154(b) by 178 days.

(21) Appl. No.: 10/523,554

(22) PCT Filed: Jul. 29, 2003

(86) PCT No.: PCT/FR03/02391

§ 371 (c)(1),
(2), (4) Date: May 23, 2005

(87) PCT Pub. No.: WO2004/015213

PCT Pub. Date: Feb. 19, 2004

(65) Prior Publication Data

US 2005/0230295 A1 Oct. 20, 2005

(30) Foreign Application Priority Data

Aug. 2, 2002 (FR) ..... 02 09895

(51) Int. Cl.
*E03F 5/06* (2006.01)

(52) U.S. Cl. ..... 210/164; 210/474; 404/4

(58) Field of Classification Search ..... 210/163, 210/164, 474, 499; 404/4, 5
See application file for complete search history.

(56) References Cited

U.S. PATENT DOCUMENTS

| | | | | | |
|---|---|---|---|---|---|
| 791,381 | A | * | 5/1905 | Thompson | 210/164 |
| 1,056,801 | A | * | 3/1913 | Kurz | 404/5 |
| 3,881,832 | A | * | 5/1975 | Maguire | 210/164 |
| 4,126,404 | A | * | 11/1978 | Ferns | 210/163 |
| 4,909,660 | A | | 3/1990 | Ferns | |
| 4,952,094 | A | * | 8/1990 | Spiess et al. | 404/4 |

FOREIGN PATENT DOCUMENTS

| | | |
|---|---|---|
| EP | 489 676 | * 11/1991 |
| EP | 506 591 | * 3/1992 |
| EP | 668409 | * 2/1995 |
| EP | 0 694 654 | 1/1996 |
| GB | 2 079 355 | 1/1982 |

* cited by examiner

*Primary Examiner*—Christopher Upton
(74) *Attorney, Agent, or Firm*—Ladas & Parry LLP

(57) ABSTRACT

The invention relates to a grate for closing a drain and similar. The inventive grate comprises an internal elastically deformable grid (2) provided with a locking pin (8) arranged on the free end thereof. Said locking pin is used for connecting the deformable grid to a frame (7) and is arranged under the external solid edge (9) of the grid in such a way that it is invisible from outside when it is incorporated into the frame (7). Said invention is used for a road network.

12 Claims, 6 Drawing Sheets

GRATE FOR CLOSING A DRAIN AND SIMILAR

The present invention concerns a grate that makes it possible to close drains, for example.

A grate is known that is intended to be mounted in a frame for closing a hole in a road and comprising interlaced grids, two external grids at the end of the grate being elastically deformable with respect to the other grids so that the grate can be fixed elastically in the frame. Each end grid is attached tightly to the grate by its two ends, between which a pin is attached that can be hooked into a notch arranged in the frame.

To take the grate out of its frame, a tool such as a crowbar is introduced between the frame and one of the end grids, which deforms in the direction of an adjacent grid in such a way as to move the pin out of its notch.

This known grate has the disadvantage that the tool necessary for extracting the grate involves a risk of damaging this elastically deformable end grid since this tool acts directly on this grid. In addition, the locking pin of each external elastically deformable grid is visible from the outside in the installed position of the grate in its frame, which makes it possible for people with bad intentions to know immediately the means for locking the grate in its frame and to open the grate fraudulently. Finally, during the manufacturing process at the foundry for such grates, when they are loose together into the recovery vat, they can bump against each other with the risk of damaging, in particular, the locking pins present on the external elastically deformable grids.

The present invention has the goal of eliminating the disadvantages above of the known grates.

For this reason, the invention suggests a grate that is intended to be mounted in a frame for closing a drain or similar and comprising interlaced grids, at least one of the grids of the grate being elastically deformable with respect to the other grids and comprising a pin that can be locked to the frame, so that the grate will be fixed elastically in the frame, and which is characterized in that the elastically deformable grid is an internal grid of the grate and has one free end comprising the locking pin that can be locked to the frame, so that the grate will be fastened elastically in the frame and that is characterized in that the deformable elastic grid is an internal grid of the grate and has a free end comprising the locking pin that is located below an exterior solid edge of the gate extending transversally to the deformable elastic grid in such a way that the pin will be a protected part, on one hand, and on the other, practically invisible from the outside in the mounted position in the frame.

Preferably the grate comprises a second elastically deformable internal grid having at its free end a pin for locking to the frame that is located below a solid exterior edge of the grate, opposite the solid exterior edge for protection of the pin of the first internal grid and extending transversally to the second elastically deformable grid, in such a way as to allow the grate to be fixed elastically in the frame, independently of their relative orientations.

The grate comprises a sheet made up in a general manner of parallel grids comprising the two elastically deformable internal grids and of transverse grids and each locking pin is an extension of the corresponding internal grid and offset toward the bottom relative to the external surface of this grid so that it can be arranged under the corresponding solid external edge of the grate and of which the external surface is in the same plane as that of the internal grid.

Each locking pin engages elastically with force in a part with the shape of a locking hook attached to the corresponding internal face of the lateral wall of the frame, and located close to one corner of this frame.

Each locking pin comprises a curved guiding ramp elongated with a free end with rounded pin engaging into the part with the shape of a locking hook at the free end that is also rounded, making it possible to elastically unlock the pin from the part with the shape of a hook at the time of removal of the grate from the frame to maintain its open position.

The grate can be removed from the frame by one side or its opposite side by introduction of a tool, such as a crowbar, in the space existing between the frame and the external grid of the grate adjacent to the internal elastically deformable grid and exercising on the external grid a lifting and unlocking force on the grate.

The grate comprises four support feet located at the four corners of the grate, respectively, that are each maintained in contact on a seating surface located in one corner of the frame by the locking force exercised by the two parts with the shape of a hook on the two locking pins.

Once unlocked on one side or the other, the grate can pivot around its opposite side relative to the frame in order to be held in the frame at an angular open position of around 120°.

Advantageously, the grate is held in the frame in its open position by two of its support feet located on one side and blocked in contact with the two upright walls of the frame, respectively, of which one is made up by one of the parts with the shape of a locking hook.

The grate can be removed directly and completely from the frame after unlocking one of the two locking pins.

The locking pins are diagonally opposed.

The parallel and transverse grids of the grate define, on one side of same, parallel openings for passage of flowing water and on the other side transverse openings for passage of flowing water and the grate is fastened in the frame in such a way that the parallel openings will be arranged on the sidewalk side and the transverse openings will be arranged on the roadway side, independently of the fastening direction of the frame in the roadway.

The invention will be better understood and other goals, characteristics, details and advantages of same will appear more clearly in the course of the explanatory description that will be given in reference to the attached schematic drawings, given solely by way of example, that illustrates an embodiment of the invention, in which:

FIG. 8 is a view similar to FIG. 7 and represents a locking pin in position before it is hooked into its corresponding locking hook when the grate is simply placed on the frame.

Figure 1:
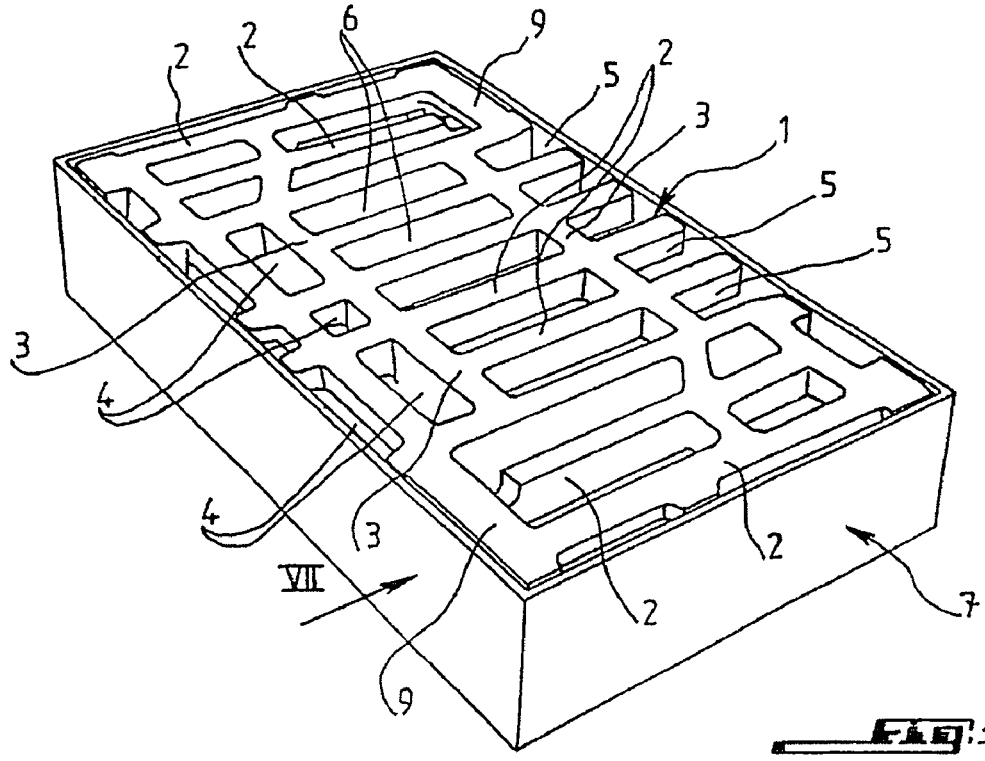
FIG. 1 is a perspective view of the grate of the invention in its position fastened in its frame.

With reference to the figures, grate 1 according to the invention essentially comprises a sheet of parallel grids 2 coming from the foundry with parallel transverse grids 3, grids 2 and 3 defining between them parallel openings 4 located on one side of the grate, parallel transverse openings 5 located on the opposite side of the grate and intermediate parallel transverse openings 6 located essentially in the center of this grate. The openings 4 to 6 make it possible to evacuate the flowing waters.

Grate 1 is fastened elastically in a frame 7, in the present case with a rectangular shape, connected to a roadway (not shown) to close a drain, it naturally being understood that it could be used to close a manhole in the roadway.

According to the invention, the grate 1 comprises two internal grids 2 that are elastically deformable with respect to the other grids 2 and making possible immobile fastening of the grate in the frame 7.

The two elastically deformable grids 2 are located opposite each other, being adjacent to two external end grids 2, respectively, located close to the walls making up the length of the frame 7 when the grate 1 is fastened in the latter.

The two elastically deformable grids 2 are connected at each of their ends of a transverse grid 3 and have, on their respective opposite free ends, two pins 8 that can be locked to the frame 7, as will be seen later and which are pointed in opposite directions to each other in the direction parallel to the length of the frame in such a way as to be essentially diagonally opposed.

Each locking pin 8 is located in an extension of the corresponding internal grid 2 and is offset toward the bottom, relative to the external surface of this grid, in order to be arranged under the corresponding solid external edge 9 of the grate 1, and of which the external surface is located in the sane plane as that of the internal grid 2. The two solid external edges 9 of the grate start from two diagonally opposed corners, respectively, of the grate and extend parallel in opposite directions over a determined distance from one side of the grate, each of these solid edges 9 being intended to meet across from the part of the longitudinal wall of the frame 7 when the grate is fastened in it. Each locking pin 8, being engaged under the solid external edge 9 of the grate, and extending along a length that is essentially equal to the length of this edge, is thus protected against shocks when the grates are manufactured in the foundry. In fact, since each locking pin 8 is located immediately below its solid external edge 9 and is thus protected from the outside when the grates are arranged loosely in a recovery vat after manufacturing, the locking pins do not have to be subjected to shocks when the grates bump into each other. In fact, when the grate 1 is fastened in the frame 7, each locking pin 8 is not simply protected from the outside by the edge 9, but is also practically invisible from the outside, thus making access to the locking pin more difficult for persons with bad intentions.

Each locking pin 8 can forcefully engage elastically in a part with the shape of a locking hook 10 that is attached to the internal face of the longitudinal wall of the frame 7 and located close to one corner of the frame, the two parts with the shape of a hook 10 naturally being located in the areas of the two diagonally opposed corners of this frame. Each part with the shape of a hook 10 extends essentially perpendicularly from a seating surface 11, which itself is perpendicular to the longitudinal wall of the frame 7.

Figure 7:
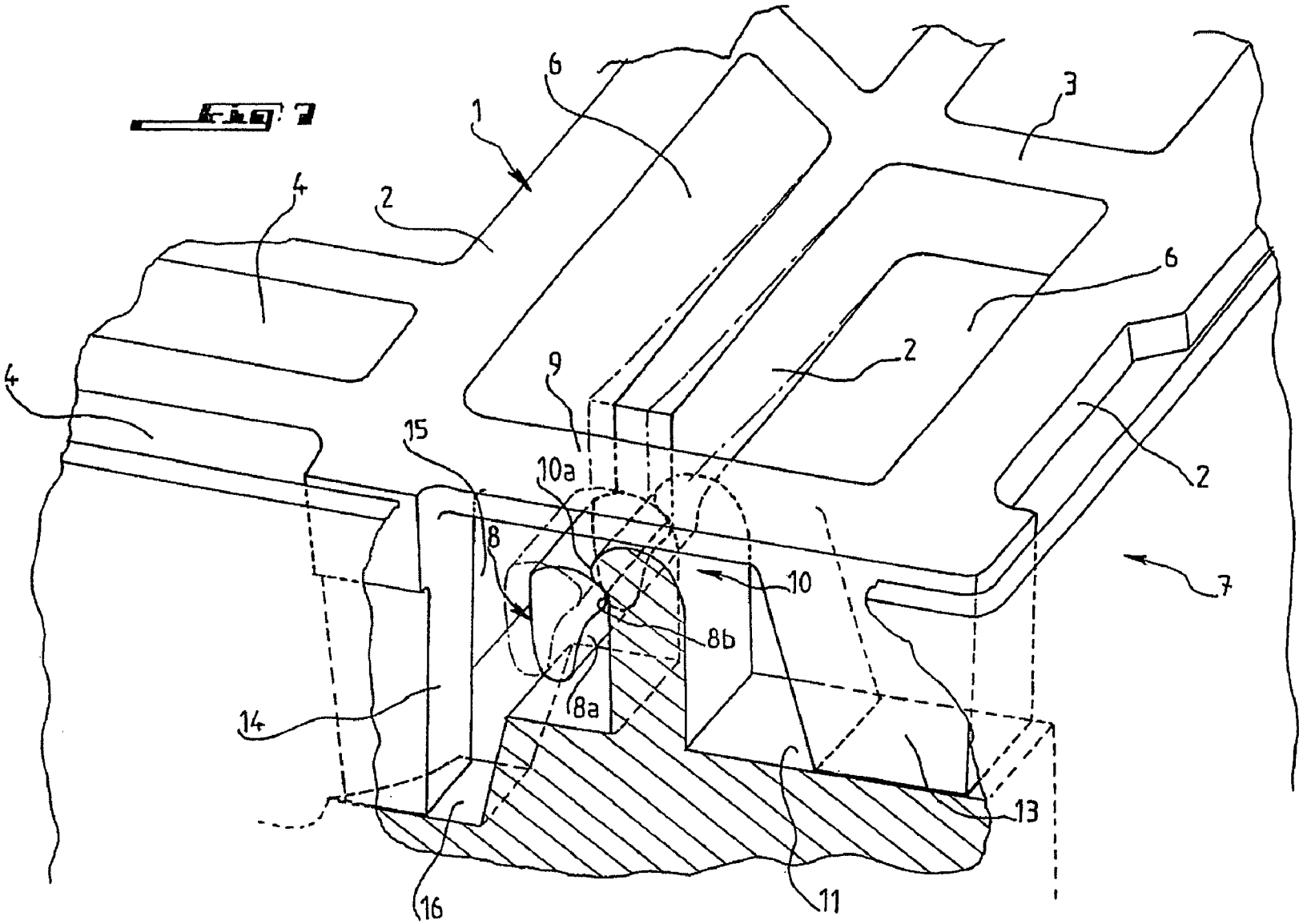
FIG. 7 is a partially cutaway and enlarged view along arrow VII in FIG. 1 showing the grate in locked position in its frame.
Figure 4:
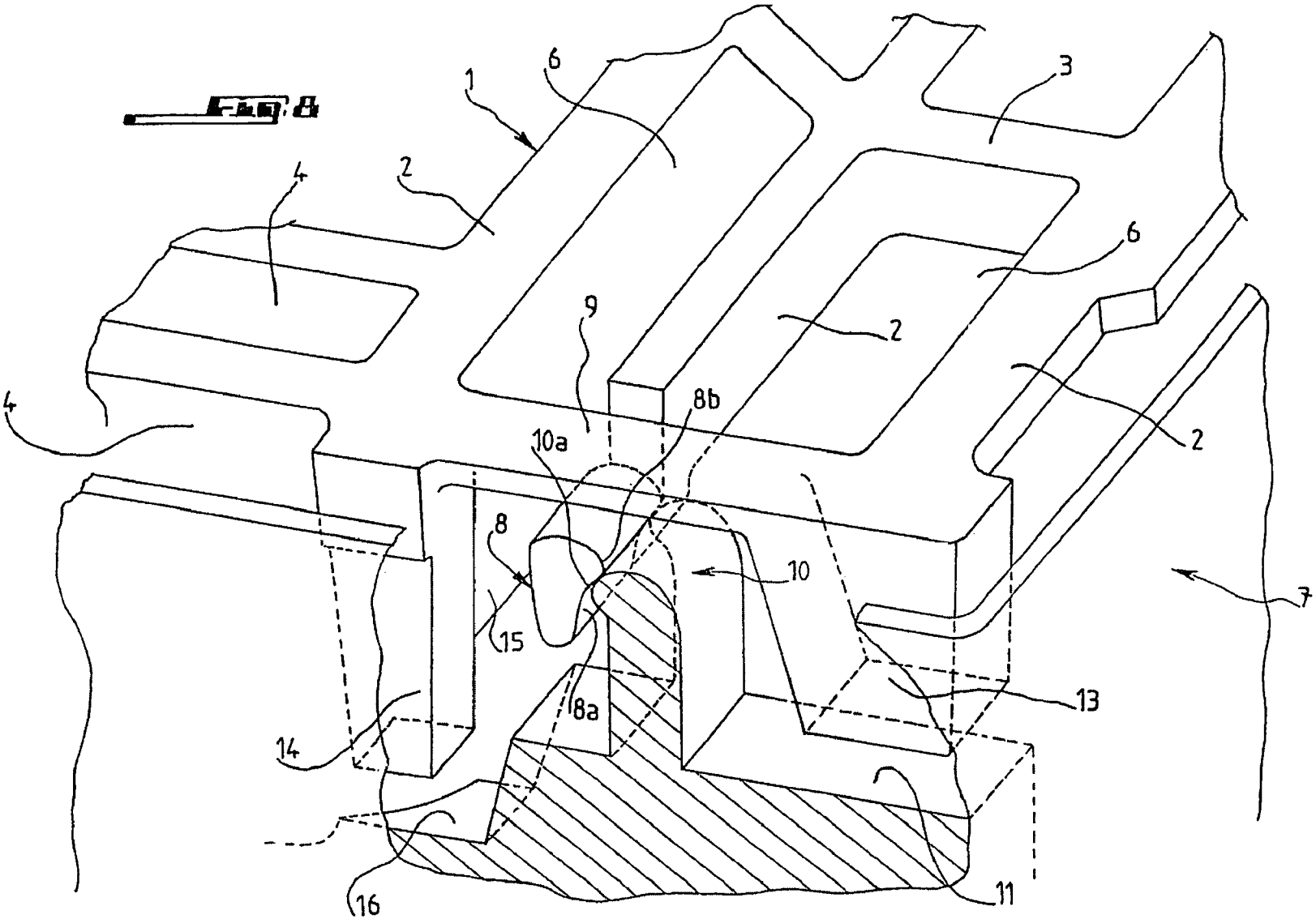

As can be seen better from FIGS. 7 and 8, each locking pin 8 which extends approximately perpendicular below its external solid edge 9, comprises a curved ramp 8*a* that ensures the guiding of the pin 8 on the rounded upper edge 10*a* of the part with the shape of a locking hook 10 and a free upper end with the shape of a rounded jaw 8*b* intended to be forcefully engaged by locking in the part with the shape of a hook 10 as shown in FIG. 7. FIG. 8 shows the position of each locking pin 8 when the grate 1 is simply placed in the frame 7 before exercising the downward force on the grate that makes it possible for the locking pins to be fastened into their respective locking hooks 10. FIG. 8 thus shows that the jaw 8*b* of each locking pin 8 is in contact with the upper rounded end edge 10*a* of the part with the shape of a locking hook 10. In addition, the rounded parts of the jaw 8*b* of pin 8 and the end 10*a* of the part with the shape of a hook 10 cooperate in such a way as to facilitate the unlocking of the pin 8 from the part 10 at the time of forceful lifting of the corresponding end of the grate with the use of an assembly tool, such as a crowbar 12.

The grate 1 also comprises four support feet 13 located in the four corners of the grate, respectively, and which come to rest, respectively, on the four seating surfaces 11 located at each corner of the frame 7 when the grate is fastened in this frame. The two parts with the shape of a locking hook 10 respectively exercise a force on the two locking pins 8 that keeps the support feet 13 in contact with the seating surfaces 11.

The grate also comprises four other support feet 14 attached to the ends of two transverse plates 15 extending perpendicularly below the upper surface of the grate 1 at the level of each parallel internal grid 2 adjacent to the corresponding elastically deformable internal grid 2. In locked position of the grate 1 in the frame 7, the four support feet 14 are maintained in contact, by locking means 8 and 10, respectively on four seating surfaces 16 as an extension of the seating surfaces 11 but at a level relatively lower than the latter. The feet 14 and the reinforcement plates 15 make it possible to prevent any deflection or deformation of the grate when heavy vehicles pass over it. In addition, each locking pin 8 is again better protected at the time when the grate is manufactured, because of the fact that it is located between two support feet 13 and 14 that project more below the grate than the pin.

The installation of the grate and its removal from the frame 7 will now be explained.

Once the frame 7 is put in place and fastened on a roadway, for example, all that is necessary is to position the grate 1 straight on the frame 7.

The locking pins 8 will then come into contact, respectively, on the upper ends of the parts with the shape of a locking hook 10 as shown in FIG. 8 and, due to the effect of a force exercised on at least one of the ends of the grate, the locking pins 8 are forcefully introduced elastically into their respective hooks 10. FIG. 7 also shows, in broken lines, the elastic deformation to which each grid 2 is subjected at the time of forceful engagement of the pin 8 in its locking hook 10. The elastic deformation of each internal grid 2 is made possible due to the fact that the grate is made of cast spheroidal graphite.

Figure 2:
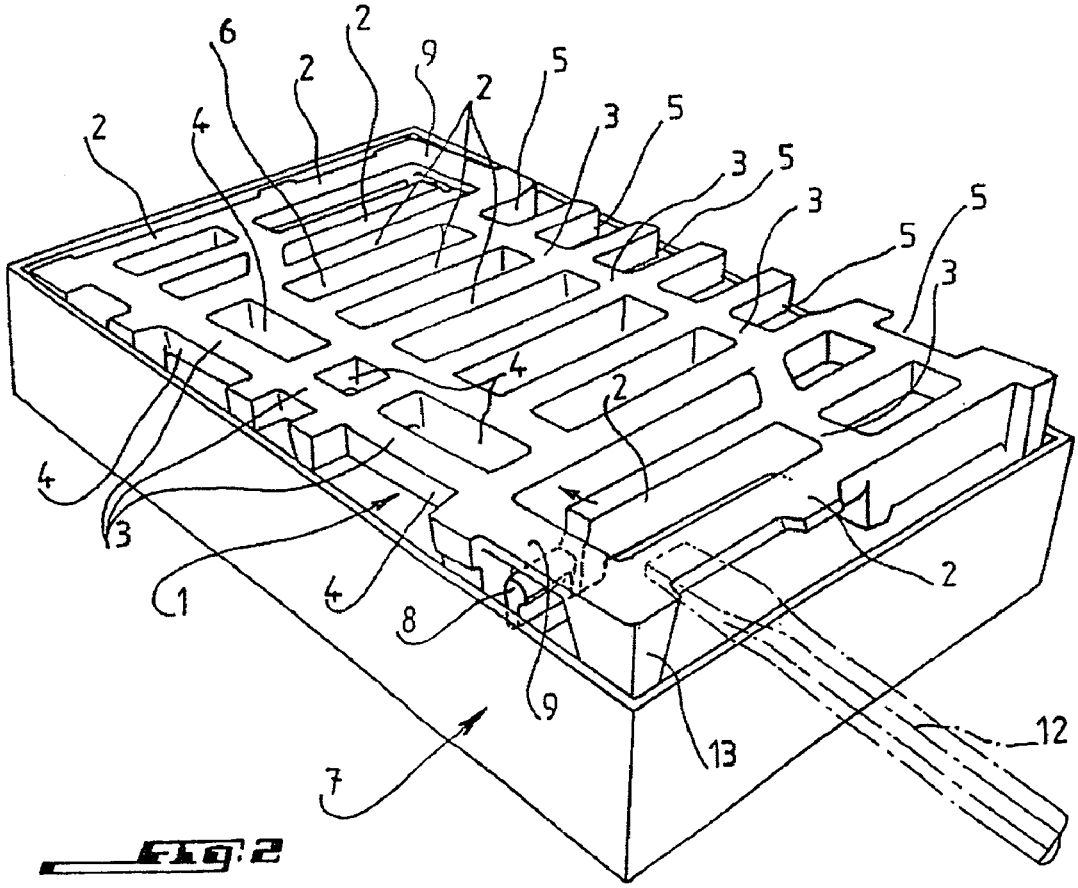
FIG. 2 is a perspective view similar to the one in FIG. 1 and showing the lifting of one side of the grate from its frame using an assembly tool.

To remove the grate 1 from its frame 7, it is only necessary to introduce the tool 12 into the space existing between the frame 7 and one of the parallel end grids 2 to lift the corresponding side of grate 1, as shown in FIG. 2, and forcefully unlock the pin 8 from its locking hook 10. In that way, the grate 1 can be lifted manually by grasping the external grid 2 and it can pivot with respect to the frame 7 with its opposite side until it is brought into its open position shown in FIG. 3 in which it is maintained, at an angular open position of around 120°, relative to the frame 7, by the two feet 13 located on the pivoting side of the grate and of which the free ends are braced in contact, on one hand, on the part with the shape of a hook 10 and on the other, on an upright wall 17 attached to the longitudinal wall of the frame 7 opposite the frame 10 and extending perpendicularly above the corresponding seating surface 11. In that way, the grate 1 is blocked in its open position by being in contact, with its corresponding side, on the two opposite seating surfaces 11. In its open position, the grate 1 can be released from this position and pulled out completely by lifting it from its frame 7. It is also possible to disengage the grate 1 totally and directly from the frame 7 at the time of unlocking one of the pins from its locking hook 10.

Figure 3:
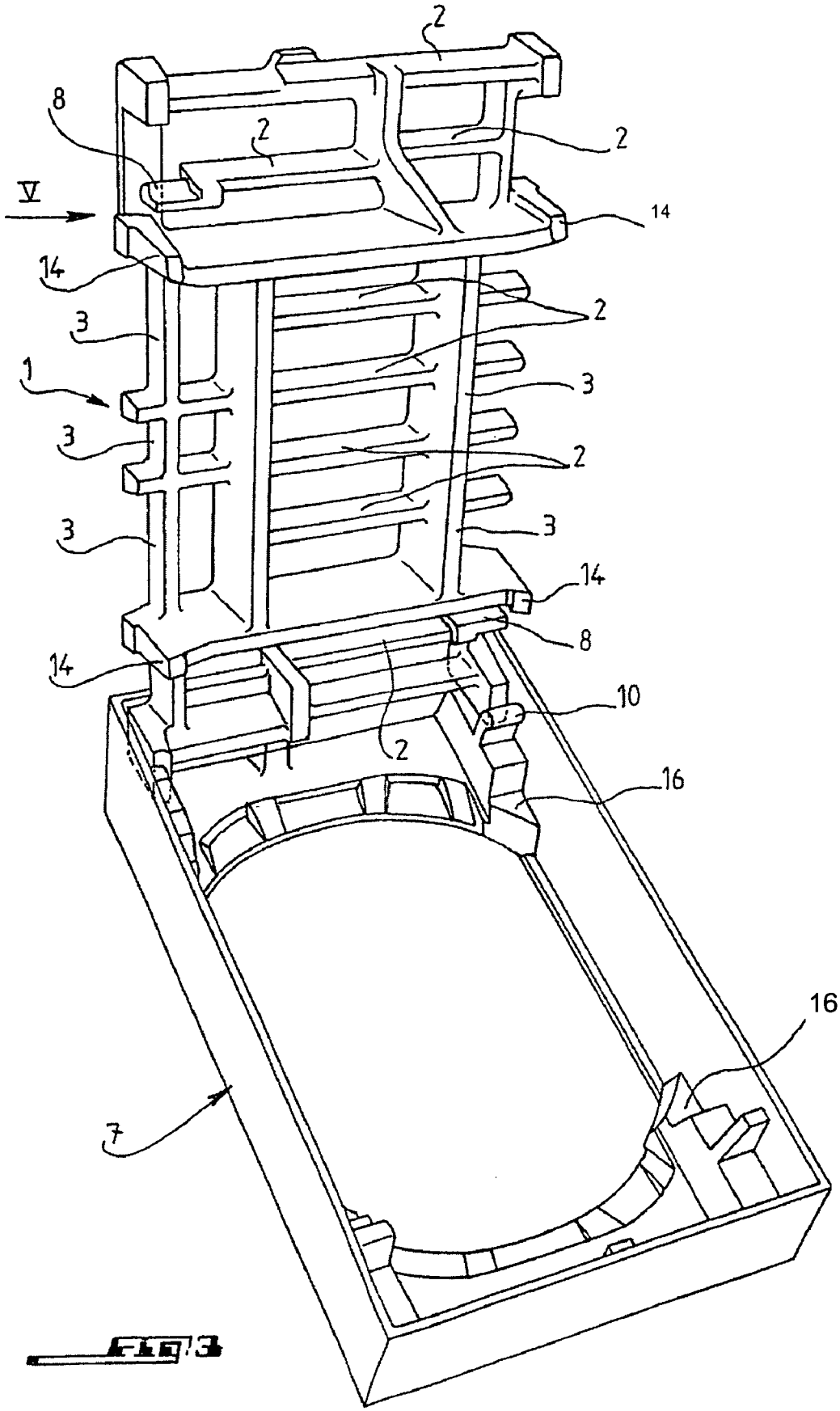
FIG. 3 is a perspective view representing the grate in a position with one side opened.
Figure 4:
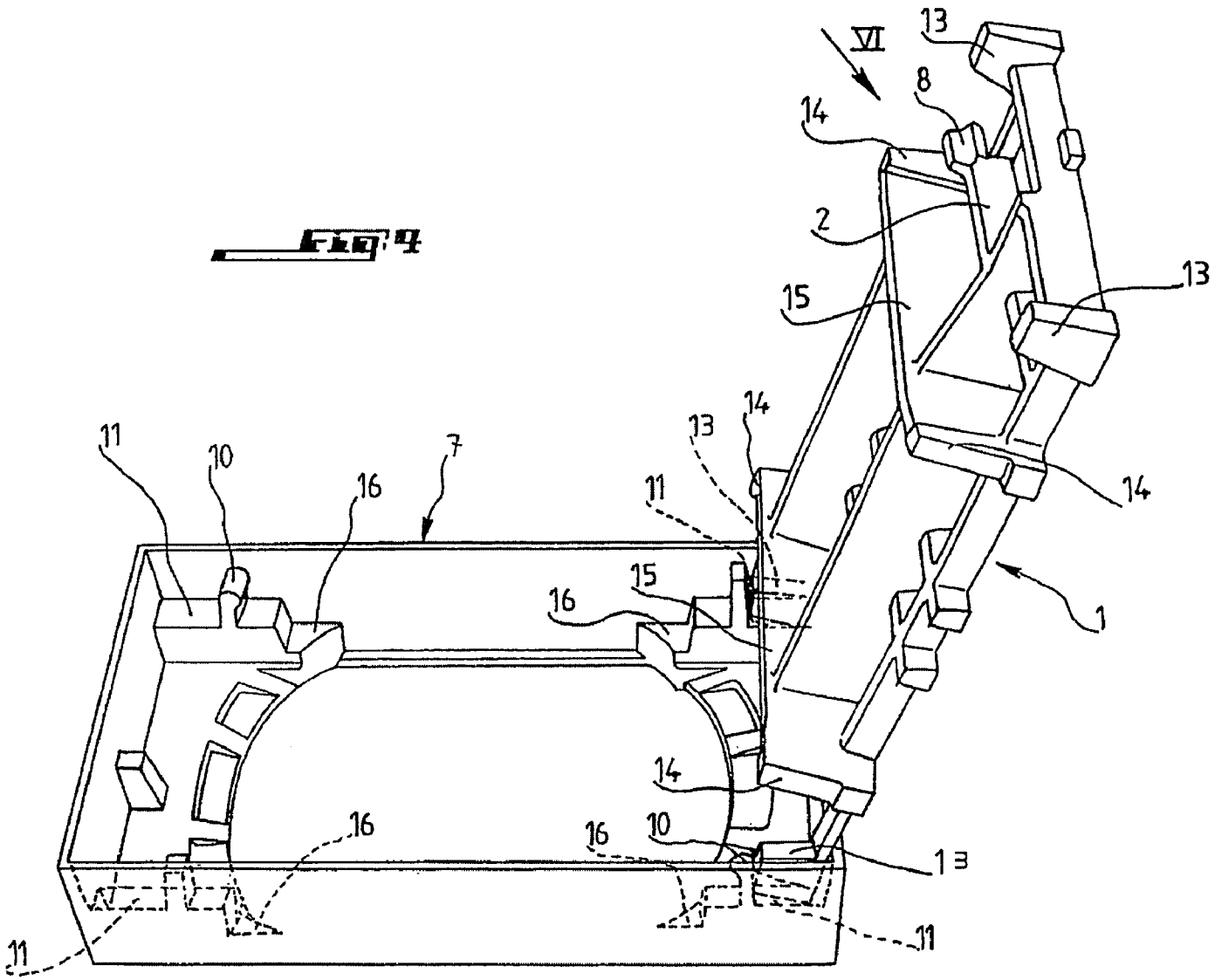
FIG. 4 is a perspective view representing the grate in the open position of the side of the frame opposite the one in FIG. 3.
Figure 5:
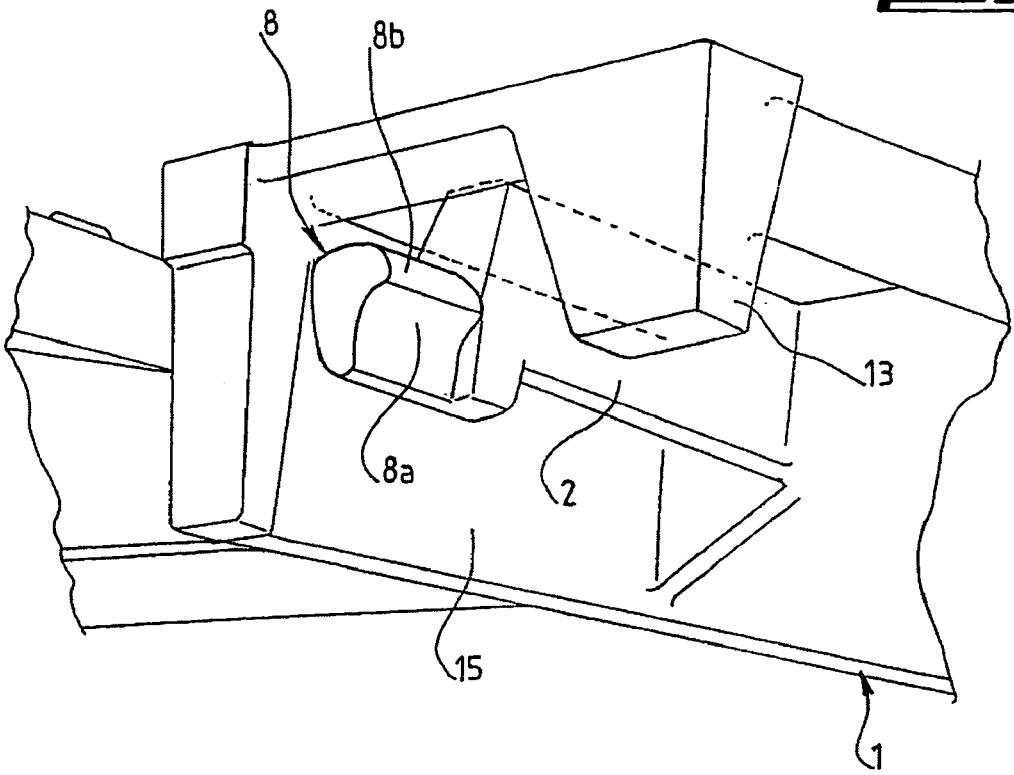
FIG. 5 is an enlarged perspective view along arrow V in FIG. 3.
Figure 6:
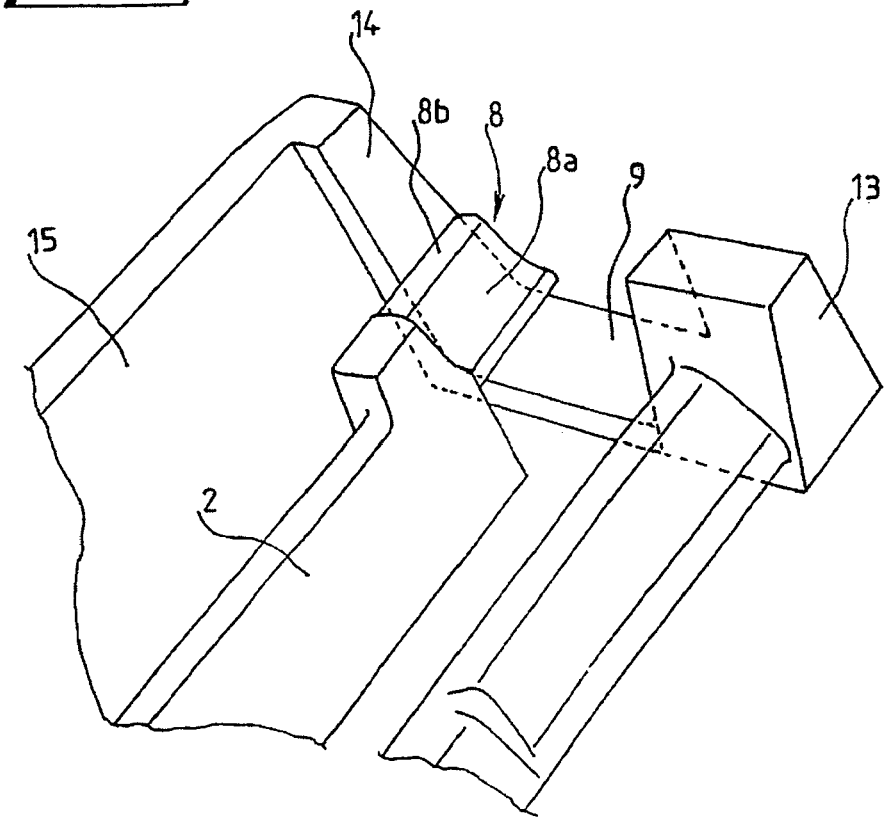
FIG. 6 is an enlarged perspective view along arrow VI in FIG. 4.

As can be seen from the preceding, the grate 1 can invariably be extracted from one side or the other using tool 12 to unlock the corresponding pin 8 from its locking hook 10 and pivoting the grate on its opposite side to open in the direction shown in FIG. 3 or to open in the other direction shown in FIG. 4. It is obvious that when the grate is unlocked on one side, the lifting of this side of grate 1 allows an automatic disengagement of the other locking pin from its associated locking hook 10.

In addition, the direction of installation of the grate 1 relative to the frame 7 can be carried out independently of their relative orientations. Thus if the frame 7 is not normally fastened in the roadway according to a specific orientation, the grate 1 can nevertheless be fastened in it, due to the specific arrangement of the locking means 8, 10. In a case where the grate 1 whose parallel openings 4 have to be arranged on the sidewalk side, independently of the direction of installation of the frame 7 in the roadway, the grate 1 could always be fastened in it in such a way that the openings 4 would effectively be located on the sidewalk side, the openings 5 being located on the roadway side. Thus the frame 7 can be arranged without any specific restriction. In the same way, if the frame 7 is arranged in the roadway with specific orientation instructions, the grate can be fastened in one direction or other in this frame, if such a grate is of a type comprising parallel and transverse grids defining regular openings oriented in the same direction.

In contrast to the known grates, the removal of the grate from its frame is carried out using a tool that does not act directly on the elastically deformable grid, but on the rigid external end grid adjacent to the elastically deformable internal grid, which completely eliminates any risk of damage to the latter.

The invention claimed is:

1. A grate mounted in a frame, the grate comprising: interlaced grids, at least one of the grids of the grate being elastically deformable with respect to the other grids;

wherein the grate includes a locking pin that releasably engages the frame so that the grate is elastically fixed in the frame, wherein the elastically deformable grid is an internal grid of the grate and at a free end of the grate the locking pin is located below a solid external edge of the grate and the locking pin extends in a direction which is transverse to the direction in which the solid external edge extends.

2. Grate according to claim 1, further comprising a second elastically deformable internal grid having at a free end of the second elastically deformable internal grid a locking pin that releasably engages the frame and which is located below another solid external edge of the grate, opposite to the solid external edge for protecting the pin of the first internal grid and extending in a direction which is transverse to the direction in which another solid external edge extends.

3. Grate according to claim 2, further comprising two parallel internal elastically deformable grids, wherein each locking pin is an extension of the two internal elastically deformable grids and the locking pins are offset toward a bottom with respect to the external surface of the elastically deformable grids so that the locking pins fit under the corresponding solid external edge of the grate.

4. Grate according to claim 3, wherein the grids on one side of the grate define openings for passage of flowing water that are orientated transversely to openings on the other side of the grate.

5. Grate according to claim 2, wherein a space is provided between the frame and the external grid of the grate adjacent to the internal elastically deformable grid.

6. Grate according to claim 2, wherein the grate pivots at a side relative to the frame until the grate is held in the frame at an angular open position of around 120°.

7. Grate according to claim 6, wherein the grate is retained in the frame in said open position by two support feet located on the same side and blocked in contact on two upright walls, respectively of the frame and of which one is made up by a part with the shape of a locking hook.

8. Grate according to claim 2, wherein the locking pins are essentially diagonally opposed.

9. Grate according to claim 1, wherein the locking pin engages elastically with force into a part with the shape of a locking hook that is attached to an internal face of the corresponding lateral wall of the frame and located close to one corner of the corresponding lateral wall of frame.

10. Grate according to claim 9, wherein the locking pin comprises a curved guiding ramp elongated by a free end with a rounded pin engaging into the part with the shape of a locking hook at the free end that is also rounded and allowing an elastic unlocking of the pin from the part with the shape of a hook at the time of removal of the grate from the frame to maintain its open position.

11. Grate according to claim 9, further comprising four support feet located at the four corners of the grate respectively, and each is maintained in contact on the seating surface located in one corner of the frame by a locking force exercised by the two parts with the shape of a hook on the two locking pins.

12. Grate according to claim 1, wherein the grate is unattached from the frame by release of the locking pin from the frame.

* * * * *